United States Patent [19]

Escaravage

[11] Patent Number: 4,736,497

[45] Date of Patent: Apr. 12, 1988

[54] BUCKLE, ESPECIALLY OF SAFETY BELT FOR A MOTOR VEHICLE

[75] Inventor: Gérard Escaravage, Valentigney, France

[73] Assignee: Aciers et Outillage Peugeot, Audincourt, France

[21] Appl. No.: 911,938

[22] Filed: Sep. 26, 1986

[30] Foreign Application Priority Data

Sep. 26, 1985 [FR] France ..... 85 14290

[51] Int. Cl.[4] ..... A44B 11/25

[52] U.S. Cl. ..... 24/641; 24/651

[58] Field of Search ..... 24/636–638, 24/633, 641, 643, 647, 650, 651; 297/468

[56] References Cited

U.S. PATENT DOCUMENTS

| | | | |
|---|---|---|---|
| 3,605,209 | 9/1971 | Alarzon | 24/637 |
| 4,310,952 | 1/1982 | Robben et al. | 24/641 |
| 4,394,792 | 7/1983 | Schmidt | 24/637 |
| 4,454,634 | 6/1984 | Haglund et al. | 24/636 |

FOREIGN PATENT DOCUMENTS

| | | | |
|---|---|---|---|
| 14787 | 11/1971 | Australia . | |
| 40143 | 11/1981 | European Pat. Off. . | |
| 94211 | 11/1983 | European Pat. Off. . | |
| 114332 | 8/1984 | European Pat. Off. | 24/641 |
| 2949923 | 6/1981 | Fed. Rep. of Germany . | |
| 3021796 | 12/1981 | Fed. Rep. of Germany . | |
| 1483220 | 6/1967 | France . | |
| 2379995 | 9/1978 | France . | |

*Primary Examiner*—Kenneth J. Dorner
*Assistant Examiner*—James R. Brittain
*Attorney, Agent, or Firm*—Sughrue, Mion, Zinn, Macpeak, and Seas

[57] ABSTRACT

This buckle is characterized by a device stressing a locking member (5) towards its locking position and a device for ejecting a bolt consist of a first elastic element (20), one end of which intended to interact with the bolt when it is inserted or ejected from the buckle, and the other end of which bears against the first bearing surface of the locking member, and by a device stressing the locking member towards its release position consistent of a second elastic element (21), one end of which bears against the body (4) of the buckle and the other end of which bears against a second bearing surface of the locking member. The first and second bearing surfaces are formed opposite one another on either side of a tongue (13) of the locking member.

12 Claims, 2 Drawing Sheets

Figure 1:
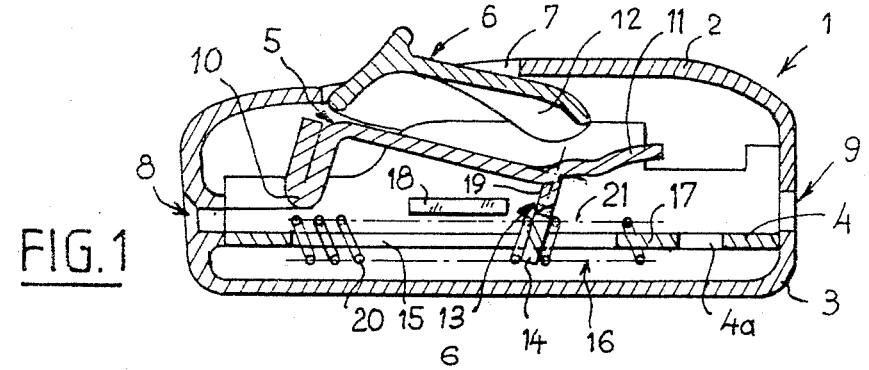

FIG.5
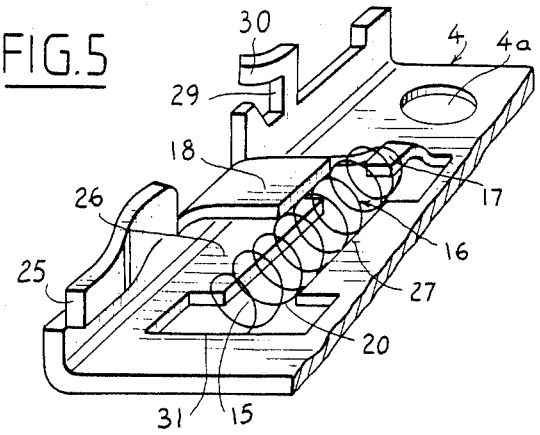
FIG.6
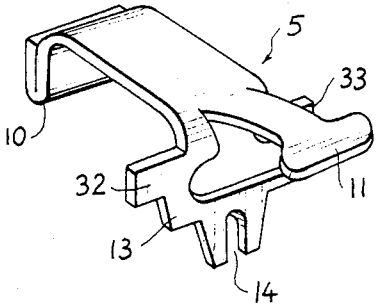
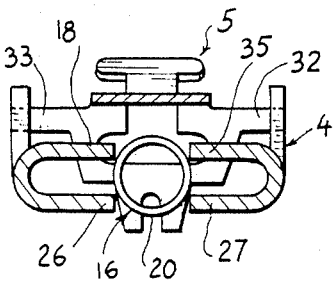
FIG. 7

BUCKLE, ESPECIALLY OF SAFETY BELT FOR A MOTOR VEHICLE

The present invention relates to devices intended for retaining a passenger of a motor vehicle in his seat in the event of the sudden deceleration of the vehicle, for example during emergency braking or a collision.

More particularly, the invention relates to a buckle which, in a device of the type mentioned, is intended for fastening removably a band of a safety belt to a fixed point on the vehicle body, for example by means of tongue forming a lock bolt.

In the state of the art, there are known buckles comprising a housing, in which is arranged a stirrup-shaped support which is intended to be fastened to a retention means fixed relative to the vehicle body and which between its wings defines a guide passage for the bolt emerging at one end of this stirrup. These buckles also have a locking member mounted in the stirrup so as to oscillate about an axis perpendicular to the wings of this stirrup, and a stop member mounted slidably in these wings and so as to be retractable by means of a control button, counter to the action of an elastic restoring device.

In this type of buckle, the bolt is retained in the buckle by a projecting part of the locking member which prevents the bolt from being withdrawn from the locking passage, for example by penetrating into an orifice made in the bolt. When a strong pull is exerted on the belt tending to remove the bolt from the buckle, this projecting part interacts with a stop edge formed in the bottom of the supporting stirrup, if appropriate as a result of the elastic deformation of the pivot pin of the locking member in the stirrup, thus making it possible to obtain a high degree of effectiveness of the buckle and a considerable bolt-retaining force.

The document FR-No. 2,482,430 likewise makes known a buckle for a safety belt, comprising a support intended to be fastened to a retention means and defining a straight passage, into which the bolt can be inserted and which defines a sliding point for the latter. The locking member of the bolt is articulated on the support about an axis extending parallel to the plane of the passage. This locking member can have a first abutment surface retaining the bolt and extending perpendicularly to the plane of the passage, at the same time being transverse to the latter, in the locked position of the buckle, whilst the locking member can also have at least one second abutment surface which, in the locked position of the buckle, is intended to come in contact with a stop member mounted on the support so as to be moveable in a translational movement, in a direction perpendicular to the pivot pin of the locking member. The movement of this stop member frees the locking member and consequently the bolt during the opening of the buckle, this being controlled by an actuating button mounted on the support in such a way that it can move in the same direction as the stop member.

Restoring springs are provided to act on the locking member, the stop member and the actuating button. The stop member is formed by a one-piece body which has members guiding and holding the springs, extending on either side of this body in opposite directions perpendicularly to the pivot pin of the locking member.

The construction of such devices has a certain number of disadvantages, particularly when it comes to keeping within somewhat narrow tolerances during production, thus increasing cost prices.

Moreover, in modern vehicle technology, the aim is as far as possible to reduce the weight and overall size of the equipment in all respects, especially with regard to the safety equipment, of course without thereby sacrificing the efficiency of this equipment.

The object of the invention is, therefore, to provide a safety-belt buckle, the construction of which is simple and easy to assemble, by reducing the number of components involved in the construction of such a buckle.

Another object of the invention is to provide a safety-belt buckle which is smaller and lighter than the buckles of the prior art and which can be produced without having to keep to narrow tolerances.

To achieve this, the subject of the invention is a buckle, especially of a safety belt for a motor vehicle, intended for fastening removably a band of the latter to a fixed point on the vehicle body, and comprising a keeper assembly and a bolt fixed to the band to be fastened, the keeper assembly comprising, accommodated in a housing, a body which is intended to be fastened to a retention means fixed to the vehicle and which delimits a passage and a sliding plane for the said bolt, a locking member of the bolt having an active part which engages into a recess in the bolt in the locking position of the latter and which is articulated on the body, so that it can tilt about an axis approximately parallel to the sliding plane and perpendicular to the direction of movement of the bolt, between a locking position and a release position of the said bolt, means stressing the locking member towards its locking position, means of ejecting the bolt, means stressing the locking member towards its release position, and means of controlling the release of the said locking member, the said buckle being characterized in that the said means stressing the locking member towards its locking position and the means of ejecting the bolt consist of first elastic means, one end of which is intended to interact with the bolt when it is inserted or ejected from the buckle, and the other end of which bears against the first bearing surface of the locking member, and in that the means stressing the locking member towards its release position consist of second elastic means, one end of which bears against the body and and the other end of which bears against a second bearing surface of the locking member.

The invention will be understood better from the following description given purely by way of example and with reference to the accompanying drawings in which:

FIGS. 1 to 4 illustrate the functioning of a safety-belt buckle according to the invention, FIG. 5 shows a perspective view of an embodiment of the body which is a component of a safety-belt buckle according to the invention, and FIG. 6 shows a perspective view of an embodiment of a locking member which is a component of a safety-belt buckle according to the invention, FIG. 7 shows a sectional view of the keeper assembly which is a component of a safety-belt buckle according to the invention.

As illustrated in FIG. 1, a safety-belt buckle according to the invention comprises a housing 1 which consists, in a way known per se, of an upper element 2 and of a lower element 3. Arranged inside of this housing 1 is a keeper assembly comprising a body 4 of a general U-shaped cross-section. A locking member 5 which takes the form of a metal strip and which will be described in more detail later is accommodated inside this body 4. A release control member 6 is mounted so as to be movable in a manner own per se between the body 4 and the upper element 2 of the housing.

The upper element 2 of the housing 1 has a slot 7, through which one end of the release control member 6 penetrates, so that the user of the safety-belt buckle has access to this member 6 in order to control the release of the buckle.

The housing 1 also has a first orifice 8, the walls of which are inclined and which opens into the body 4 and defines a passage and a sliding plane for a bolt fixed to a safety-belt band to be fastened.

The housing 1 also has a secondary orifice 9 which is formed in the end of the housing opposite the end in which the orifice 8 is made. This orifice 9 is formed opposite one end of the body 4 and is intended, for example, to allow the passage of a retention means (not shown), one end of which is fastened to the vehicle and the other end of which is secured to the body 4, for example by means of a recess 4*a* made in the latter, in order to fix the body 4 to the vehicle.

According to another embodiment of the safety-belt buckle according to the invention, part of the body 4 can project outside the housing 1 through the orifice 9, to allow an assembled buckle to be mounted on a vehicle. This construction of the buckle makes it possible to achieve a greater versatility of the latter.

The locking member 5 has, at one of its ends, an active part 10 consisting, for example, of a double-thickness projection of the material forming this member. At its end opposite this active part, the locking member 5 has an actuating surface 11 intended to interact with a cam-forming surface 12 of the release control member 6.

The locking member 5 also has a tongue 13 extending in the direction of the body 4 and having a notch 14, the function of which will be defined later. This tongue projects into a slot 15 made in the body 4, as will be described in more detail later.

This tongue 13 extends between two turns of a spring 16, one of the ends of which is arranged on a centring stud 17 integral with the body, and the other end of which bears against the first edge of the slot 15 in the released position of the buckle.

The notch 14 in the tongue 13 of the locking member allows the wire forming the spring 16 to pass through, so that the tongue has a first and a second bearing surface interacting with the respective spring parts arranged on either side of this tongue.

As will be seen later, one of the spring parts is guided by the slot 15 and at least one guide lug 18 extending above the latter.

It should also be noted that the tongue 13 of the locking member 5 has projecting parts, described in more detail later, which extend on either side of this tongue and which define an axis 19 for the pivoting of . this locking member on the body, this pivot axis being approximately parallel to the sliding plane and perpendicular to the direction of movement of the bolt in the body. This pivot allows the locking member to tilt between a locking position and a release position.

In the release position of the buckle, shown in this FIG. 1, the parts of the spring 16 extending on either side of the tongue 13, that is to say a first part 20, one of the ends of which bears on the first edge of the slot 15 and the other end of which bears on the first bearing surface of the tongue 13, and a second part 21, one of the ends of which is arranged on the centring stud 17 and the other end of which bears against the second bearing surface of the tongue, exert an equal force on this tongue so as to define the release position of the locking member 5.

In this embodiment, the first and second parts of the spring act in a direction approximately parallel to the sliding plane of the bolt.

It should be noted that the tongue 13 is not arranged in the middle of the spring 16, so that the number of turns of the first part of the latter is greater than the number of turns of the second. Thus, the force of the first part exceeds that of the second, and the position of equilibrium shown in this FIG. 1 is obtained because the distance separating the tongue 13 from the first edge of the slot 15 is greater than that separating the same tongue 13 from the centring stud 17.

Figure 2:
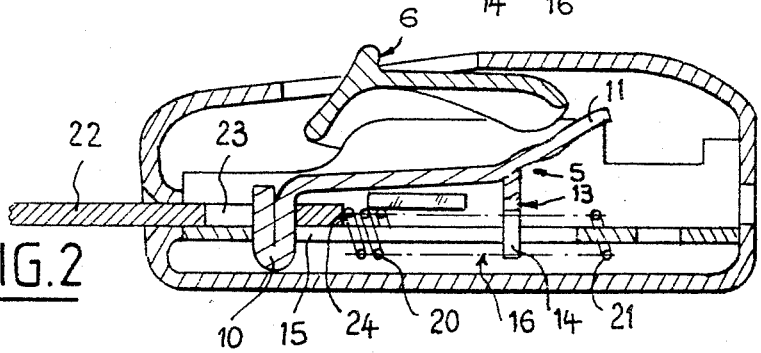
Figure 3:
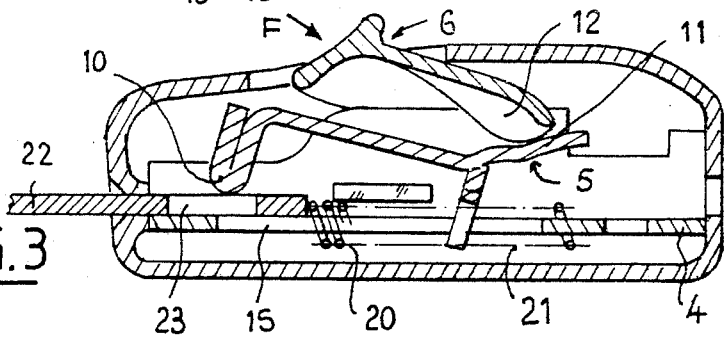

This can be seen in FIG. 2, which shows a safety-belt buckle according to the invention in the locked position, when a bolt 22 having a recess 23 is inserted into the buckle, the front face 24 of this bolt 22 comes up against the end of the first part 20 of the spring 16 which was up against the first edge of the slot 15. The effect of this is to cancel the equilibrium of forces exerted on the tongue 13 of the locking member 5. In fact, the force exerted by the part 20 of the spring becomes greater than that exerted by the part 21, so that the locking member tilts about its pivot axis, until the active part 10 bears on the upper surface of the bolt 22. The bolt 22 continuing to be engaged, the spring part 20 is compressed to an increasing extent, so that when the recess 23 of the bolt comes opposite the active part 10 of the locking member 5 the latter tilts towards the locking position shown in this Figure, in which the active part 10 interacts with the edge of the slot 15, which thus forms a stop edge, and with one edge of the recess 23 of the bolt 22, to retain the latter in the buckle. In this position the force exerted by the part 20 of the spring 16 is greater than that exerted by the part 21, so that the locking member is held in the locking position.

When a force F (FIG. 3) is exerted on the release control member 6, the cam-forming surface 12 of the latter comes up against the actuating surface 11 of the locking member 5. The effect of this is to tilt the locking member 5 counter to the action exerted by the part 20 of the spring. If the action is continued until the active part 10 of the locking member 5 is disengaged from the slot 15 in the body 4 and from the recess 23 in the bolt 22, the latter is then no longer retained in the buckle and the part 20 of the spring expands to eject the bolt 22 from the buckle.

Figure 4:
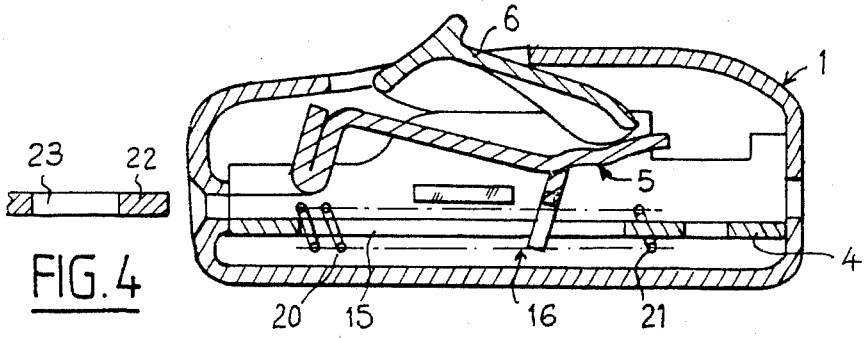

As can be seen in FIG. 4, this expansion of the part 20 of the spring continues as long as the end of the latter is not up against the first edge of the slot 15, so that the forces exerted by this first part of the spring and by the second part of the latter are equal and thus define the release position, as described with reference to FIG. 1.

It will therefore be seen that the first part 20 of the spring 16, one of the ends of which is intended to interact with the bolt when it is inserted or ejected from the buckle, and the other end of which bears against a first bearing surface of the locking member, constitutes first elastic means which stress the locking member towards its locking position when the bolt is inserted into the buckle and which eject the latter from the buckle when an action is exerted on the release control member. The second part 21 of the spring, one of the ends of which bears against the body 4 and the other end of which bears against a second bearing surface of the locking member, itself constitutes second elastic means stressing the locking member 5 towards its release position, following the actuation of the release control member.

The first and second bearing surfaces of the locking member are formed opposite one another on either side of the tongue 13 of the latter.

FIG. 5 shows an embodiment of the body 4 which is a component of the safety-belt buckle according to the invention.

As has already been seen, this body 4 has a passage for the end of the bolt, this passage being delimited by two edges, only one 25 of which is shown and which are formed in the two branches of the U constituting the said body. This body 4 possesses, in its central part, the slot 15 which has two edges 26 and 27 for guiding the spring 16 and more particularly the first part 20 of the latter. The body 4 also has at least one guide lug 18 advantageously produced in one piece with one of its wings and extending at least partially above this part 20 of the spring 16 to ensure its guidance, the first part 20 of the spring being arranged between the edges 26 and 27 of the slot 15 and the said at least one guide lug.

The wings of the body 4 likewise have receptacles, only one 29 of which is shown, these receptacles being open in their upper part, to make it possible to mount the locking member, and having fins 30 which, after this locking member has been mounted, can be turned down to retain the projecting parts of the latter in these receptacles.

As has been seen, one of the ends of the spring 16 is arranged on the centring stud 17, whilst its other end comes up against a first edge 31 of the slot 15.

The locking member 5 shown in FIG. 6 has, at one of its ends, the active part 10 which consists, for example, of a double-thickness projection of the material forming this locking member. At its other end, the locking member has the actuating surface 11 which can advantageously consist of a cut-out part of the tongue 13. On either side of this tongue 13 extend two projecting parts 32 and 33 which define the axis 19 for the pivoting of the locking member on the body and which fit into the receptacles 29 of the latter, in order to allow the locking member to tilt relative to the said body. The tongue 13 also has the notch 14, through which passes the wire forming the spring 16.

As can be seen in FIG. 7, the projecting parts 32 and 33 of the locking member 5 are arranged in the corresponding receptacles of the wings of the body 4. The part 20 of the spring is located between the edges 26 and 27 of the slot 15 of the body 4 and, for example, two guide lugs 18 and 35 produced integrally with this body 4. The spring 16 is thus retained at four points.

What is claimed is:

1. Buckle, especially of a safety-belt for a motor vehicle, intended for fastening removably a band of the belt to a fixed point on the vehicle and comprising a keeper assembly and a bolt fixed to the band to be fastened, the keeper assembly comprising a housing surrounding a body which is intended to be fastened to a retention means fixed to the vehicle and which delimits a passage and a sliding plane for said bolt, a locking member means of the bolt having an active part which engages into a recess in the bolt in the locking position of the latter and articulated on the body so that said locking member means can tilt about an axis approximately parallel to the sliding plane and perpendicular to the direction of movement of the bolt, between a locking position and a release position of the bolt, means stressing the locking member means towards its locking position, means for ejecting the bolt, means stressing the locking member means towards its release position, and release control member means for controlling the release of said locking member means from the locking position, characterized in that the means stressing the locking member means towards its locking position and the means of ejecting the bolt consist of first elastic means, one end of which is intended to interact with the bolt when the bolt is inserted or ejected from the buckle, and the other end of which bears against a first bearing surface of the locking member means, in that the means stressing the locking member means towards its release position consists of second elastic means, one end of which bears against the body and the other end of which bears against a second bearing surface of the locking member means, in that the first and second elastic means consist of a single spring, one end of which is arranged on a stud of the body and the other end of which is intended to interact with the bolt, a tongue of the locking member means extending between two turns of the spring, thus defining the first and second elastic means, and in that said release control member means contacts an actuating surface on the locking member means, said actuating surface being located on an end of the locking member means which is opposite the active part relative to the tilt axis and which is further distant from the passage than the tilt axis.

2. Buckle according to claim 1, characterized in that the first and second bearing surfaces are formed opposite one another on either side of the tongue of the locking member means.

3. Buckle according to claim 2, characterized in that the actuating surface of the locking member means consists of a cut-out part of the tongue.

4. Buckle according to claim 2, characterized in that said tongue has projecting parts, which define the axis for the pivoting of the locking member means on the body.

5. Buckle according to claim 4, characterized in that the projecting parts are engaged into receptacles formed in the the wings of the body, to allow the locking member means to tilt between its two positions.

6. Buckle according to claim 5, characterized in that the receptacles are open in their upper part, to allow the locking member means to be mounted, and have fins which, after said locking member means has been mounted, can be turned down to retain said projecting parts in said receptacles.

7. Buckle according to claim 2, characterized in that the tongue has a notch for the passage of the wire forming the single spring.

8. Buckle according to claim 1, characterized in that the first and second elastic means act in a direction approximately parallel to the sliding plane of the bolt, and in that the force of the first means is greater than that of the second means.

9. Buckle according to claim 1, characterized in that the number of turns of the first elastic means is greater than the number of turns of the second elastic means.

10. Buckle according to claim 1, characterized in that the body has means of guiding the first elastic means.

11. Buckle according to claim 10, characterized in that said guiding means consist of two edges of a slot formed in the body and of at least one guide lug integral with the body, the first elastic means being arranged between the edges of the slot and said at least one lug.

12. Buckle according to claim 11, characterized in that, in the locking position, the active part of the locking member means interacts with a stop edge of the slot and with one edge of the recess of the bolt, in order to retain the latter in the locked position.

* * * * *